US010143618B2

(12) United States Patent
Cambridge

(10) Patent No.: US 10,143,618 B2
(45) Date of Patent: Dec. 4, 2018

(54) STIMULATION REMOTE CONTROL AND DIGITAL FEEDBACK SYSTEM

(71) Applicant: THIKA HOLDINGS LLC, St. Pete Beach, FL (US)

(72) Inventor: Vivien Johan Cambridge, Myrtle Beach, SC (US)

(73) Assignee: THIKA HOLDINGS LLC, St. Pete Beach, FL (US)

( * ) Notice: Subject to any disclaimer, the term of this patent is extended or adjusted under 35 U.S.C. 154(b) by 0 days.

(21) Appl. No.: 14/743,212

(22) Filed: Jun. 18, 2015

(65) Prior Publication Data

US 2015/0366748 A1 Dec. 24, 2015

Related U.S. Application Data

(60) Provisional application No. 62/172,069, filed on Jun. 6, 2015, provisional application No. 62/172,065, filed
(Continued)

(51) Int. Cl.
*A61H 19/00* (2006.01)
*A61H 23/02* (2006.01)

(52) U.S. Cl.
CPC ..... *A61H 19/44* (2013.01); *A61H 19/32* (2013.01); *A61H 23/0254* (2013.01); *A61H 2201/149* (2013.01); *A61H 2201/165* (2013.01); *A61H 2201/1635* (2013.01); *A61H 2201/501* (2013.01); *A61H 2201/5043* (2013.01); *A61H 2201/5061* (2013.01); *A61H 2201/5071* (2013.01); *A61H 2201/5084* (2013.01); *A61H 2201/5092* (2013.01); *A61H 2201/5097* (2013.01)

(58) Field of Classification Search
CPC .. A61H 19/32; A61H 19/44; A61H 2201/149; A61H 2201/1635; A61H 2201/165; A61H 2201/501; A61H 2201/5043; A61H 2201/5061; A61H 2201/5071; A61H 2201/5084; A61H 2201/5092; A61H 2201/5097
See application file for complete search history.

(56) References Cited

U.S. PATENT DOCUMENTS 3,504,665 A 4/1970 Bakunin et al.
4,790,296 A 12/1988 Segal
(Continued)

OTHER PUBLICATIONS

Search Report and Written Opinion dated Sep. 18, 2015 received in the corresponding PCT Application (PCT/US15/36434).
(Continued)

*Primary Examiner* — Christine H Matthews
(74) *Attorney, Agent, or Firm* — Volpe and Koenig, P.C.

(57) ABSTRACT

A system for sexual interaction is provided. The system includes a phallic device for sexual interaction having a sensor for sensing its movement and a transmitter for transmitting data to a processor connected to the phallic device. The first processor determines an output signal based at least in part on the movement of the phallic device, and the first processor communicates the output signal to an output device. The output device includes a second remote processor that is configured to receive the output signal from the phallic device, wherein the output signal is adjusted corresponding to the movement of the phallic device and the signal is used to control a device located at remote location.

5 Claims, 11 Drawing Sheets

Related U.S. Application Data on Jun. 6, 2015, provisional application No. 62/172,064, filed on Jun. 6, 2015, provisional application No. 62/015,545, filed on Jun. 23, 2014, provisional application No. 62/014,059, filed on Jun. 18, 2014, provisional application No. 62/014,053, filed on Jun. 18, 2014.

(56) References Cited

U.S. PATENT DOCUMENTS

| | | | |
|---|---|---|---|
| D320,087 | S | 9/1991 | Sholzberg et al. |
| 5,076,261 | A | 12/1991 | Black |
| 5,460,597 | A | 10/1995 | Hopper |
| 5,501,650 | A | 3/1996 | Gellert |
| D384,156 | S | 9/1997 | Kain |
| 5,725,473 | A | 3/1998 | Taylor |
| 5,933,600 | A | 8/1999 | Shieh et al. |
| 6,049,806 | A | 4/2000 | Crecine |
| 6,142,929 | A | 11/2000 | Padgett |
| 6,169,914 | B1 | 1/2001 | Hovland et al. |
| 6,203,491 | B1 | 3/2001 | Uribe |
| 6,368,268 | B1 | 4/2002 | Sandvick et al. |
| D466,218 | S | 11/2002 | Dalton et al. |
| 6,533,718 | B1 | 3/2003 | Ritchie et al. |
| 6,592,516 | B2 | 7/2003 | Lee |
| 6,658,400 | B2 | 12/2003 | Perell et al. |
| 6,786,863 | B2 | 9/2004 | Abbasi |
| 6,793,619 | B1 | 9/2004 | Blumental |
| 6,868,391 | B1 | 3/2005 | Hultgren |
| 7,010,530 | B2 | 3/2006 | Bartkowiak et al. |
| 7,056,281 | B2 | 6/2006 | Bookwalter et al. |
| 7,104,950 | B2 | 9/2006 | Levy |
| 7,267,646 | B2 | 9/2007 | Tucker |
| 7,438,681 | B2 | 10/2008 | Kobashikawa et al. |
| 7,608,037 | B2 | 10/2009 | Levy |
| 7,762,945 | B2 | 7/2010 | Blumenthal |
| 8,255,299 | B2 | 9/2012 | Cambridge |
| 8,308,631 | B2 | 11/2012 | Kobashikawa et al. |
| 8,608,644 | B1 | 12/2013 | Davig |
| 2002/0059102 | A1 | 5/2002 | Sung et al. |
| 2002/0103415 | A1 | 8/2002 | Manska et al. |
| 2003/0036678 | A1 | 2/2003 | Abbassi |
| 2003/0073881 | A1 | 4/2003 | Levy et al. |
| 2003/0144924 | A1 | 7/2003 | McGee |
| 2004/0082831 | A1 | 4/2004 | Kobashikawa et al. |
| 2010/0045595 | A1 | 2/2010 | Bakke |
| 2013/0116502 | A1 | 5/2013 | Cambridge |
| 2017/0112711 | A1 | 4/2017 | Cambridge |

OTHER PUBLICATIONS

Notice of Allowance dated Apr. 24, 2012 in U.S. Appl. No. 10/670,030.

Office Action dated Nov. 17, 2010 in U.S. Appl. No. 10/670,030.

Office Action dated Aug. 11, 2011 in U.S. Appl. No. 10/670,030.

Website: virtualsexmachine.com; "Weclome to the Future of Virtual Sex"; copyrights 1997-2000; 1997-2010; accessed Feb. 2, 2017 (13 pages).

Online Publication: CNET; "Virtual Sex Machine inventor seeks adult video stars" published Aug. 6, 2007 (2 pages).

"Fleshlight Announces Release of Vstroker" (website) (https://avn.com/business/articles/novelty/fleshlight-announces-release-of-vstroker-485023.html) (dated Aug. 9, 2012).

"Kiiroo and Fleshlight are teaming up to make the best, even better." (website) (http://www.pressat.co.uk/releases/kiiroo-and-fleshlight-are-teaming-up-to-make-the-best-even-better-1d75d5b100b971600c53155cf07ecfce/) (dated Nov. 13, 2014).

"Teledildonics: The Weird, Wonderful World of Social Sex Toys" (website) (https://gizmodo.com/teledildonics-the-weird-wonderful-world-of-social-sex-1516075707) (dated Feb. 7, 2014).

"Lovense—About Us" (website) (https://web.archive.org/web/20140326013804/https://www.lovense.com/sextoys/aboutus) (Archived from Mar. 26, 2014).

STIMULATION REMOTE CONTROL AND DIGITAL FEEDBACK SYSTEM

INCORPORATION BY REFERENCE

The following documents are incorporated herein by reference as if fully set forth: U.S. Provisional Patent Application No. 62/172,069, filed Jun. 6, 2015; U.S. Provisional Patent Application No. 62/172,065, filed Jun. 6, 2015; U.S. Provisional Patent Application No. 62/172,064, filed Jun. 6, 2015; U.S. Provisional Patent Application No. 62/015,545, filed Jun. 23, 2014; U.S. Provisional Patent Application No. 62/014,059, filed Jun. 18, 2014; and U.S. Provisional Patent Application No. 62/014,053, filed Jun. 18, 2014.

FIELD OF INVENTION

The present invention is generally related to an erotic device, and is more specifically related to a remote control and digital feedback stimulation system.

BACKGROUND

Erotic interactive computer games and erotic Internet interaction between partners using cam has progressed in recent years to include connected devices that add a physical element to the activity. Particularly, users can use devices to simultaneously sexually stimulate themselves and send data to computer games or to remote connected toys where that data is related to the movements or state of the user's devices. Devices of the current art include dildos, sex toys that are often explicitly phallic in appearance and intended for bodily penetration during masturbation or sex with partners. These dildos can usually detect penetration through touch sensitive elements on the surface or inside the device. Currently such technology is expensive and there have been reports of injury resulting from the use of this new technology.

Interactive social communication devices today dominate the world and our current invention aims to make it possible for one partner to engage in simulated sexual acts between two partners on opposite ends of a digital connection where one partner uses his or her hand to masturbate and the other partner has a device that senses this hand motion and which device moves a phallic object in synchronized fashion with those hand motions and where mechanical outputs are video imaged and where live video of mechanical outputs is transmitted back to customer's end of the connection so that customer can observe, steer, and directly control erotic actions that occur at the website's end of the connection.

Entertainment software for the adult industry lets users interact with artificial characters on computer screens. In these games, users can direct the action as they request characters to perform acts and as they communicate with the characters through artificial intelligence components of the software. Most of these so called Virtual Reality games use artificially generated characters that are rendered in 3D on the computer screen. In these games the user can move through a virtual world and interact with the characters by viewing them, touching them, and talking to them. Other games use photo-realistic video clips of actual actresses and string the clips together in a game where the user can move the video to specific clips based on the specific action that he wants to see.

There are currently web based adult entertainment services that allow customers to chat with performers for a fee.

In the current web based adult entertainment services, the interaction between customers and performers is generally through on-line chat combined with a life streaming video connection. Performers are female or male actors who pose for the customers and interact with customers through the Internet. Online chat is generally the process wherein persons connected to the Internet type words that are transmitted and displayed on other people's screen. Compared to pre-recorded on-line photos and movies, these web based Adult Services offer the customer has a sense of interaction and connection that increases the intensity of the fantasy that is the product of the Web based service. For example, the customer may ask, through on-line chat, the model to wave her left hand. When the model responds, the customer knows that the interaction is occurring in real time with the model displayed on his or her computer screen.

SUMMARY

An alternative phallic input device that uses inexpensive movement sensing technology is provided. The phallic input device uses movement sensing technology, such as accelerometers, to detect the movement of the phallic object. This movement data is transmitted to a processor for use in erotic software or for transmission to a remote processor for use in with a remote erotic device. The device may furthermore include force sensing means for detecting contact with a surface or orifice. Additionally, wrapping a measuring device around a human hand, wrist, or forearm is provided. The wrapping device uses movement sensing technology, such as accelerometers, to detect the movement of the wrapped object. This movement data is transmitted to a processor for use in erotic software or for transmission to a remote processor for use in with a remote erotic device. The wrapping device may also include force sensing means for detecting contact with a surface or orifice.

One utility of this invention is the improvement in the perception of erotic acts of between two individuals who are at separate physical locations and who are engaging each other through connected electronic devices.

Alternatively the device of the system of the present invention detects certain sex acts and other physical data generated by the user so that a computer game presents to the user the illusion of physical sex with the character depicted in the game.

DETAILED DESCRIPTION OF THE PREFERRED EMBODIMENT(S)

Figure 1:
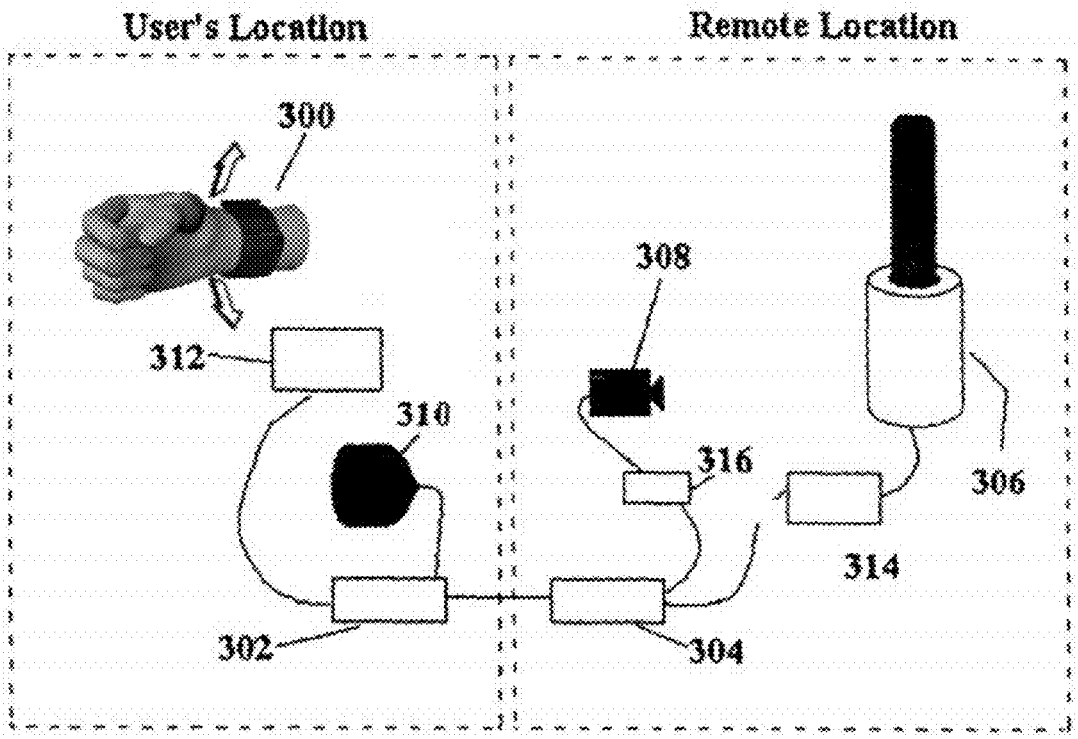
FIG. 1 shows a system including a user's location and remote location for a remote interaction system.

A system including a tubular object, which is a human hand, and a measuring device attached to the human hand, wrist, forearm or body so that said measuring device generates data which data is related to the position of the hand is provided. As shown in FIG. 1, the remote interaction system of the present invention generally includes an input device 300 for receiving physical inputs from a first user which are related to masturbating movements by said first user. Digitizing and transmission components 312 and a processing unit 304 are provided for transmitting an electronic signal related to said physical inputs to a remote location. An output device 306 and associated signal processing component 314 are provided for creating mechanical movements of a phallic object in a remote location. A video camera 308 is provided for imaging mechanical movements and their effects at a remote user's location. Video digitizing and transmission components 316 are provided for sending a live video feed back to user's location. Display means 310 are provided through which user can observe movements at a remote location as portrayed in said live video feed so that the user can better control and perceive the effects of said physical inputs. A processing unit 302 is provided connected to the display means 310 and the digitizing and transmission components 312. Each of the components in FIG. 1 can include wired or wireless connections to each other.

Figure 2A:
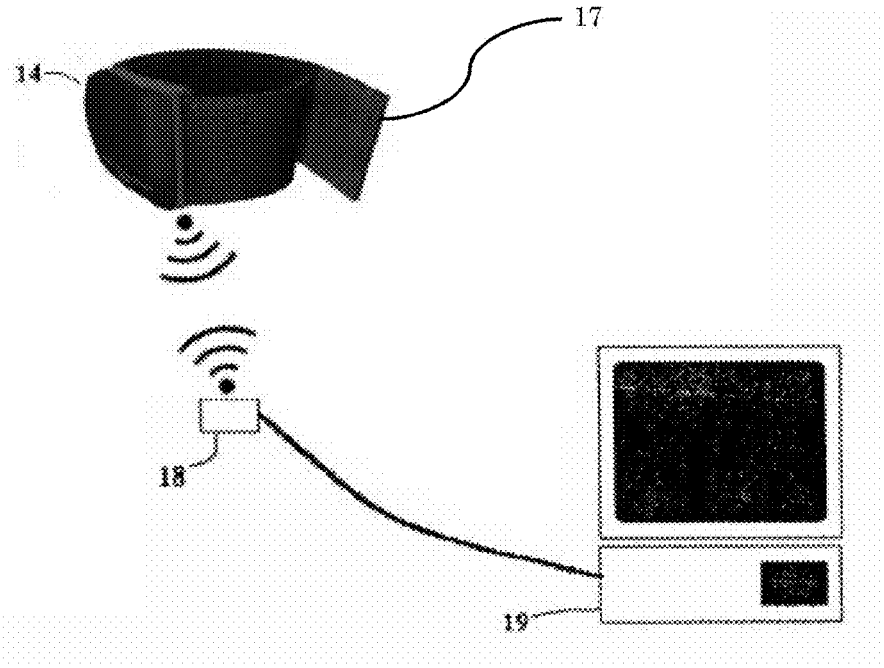
FIGS. 2*a* and 2*b* show the input device of the remote interaction system at a local site.
Figure 2B:
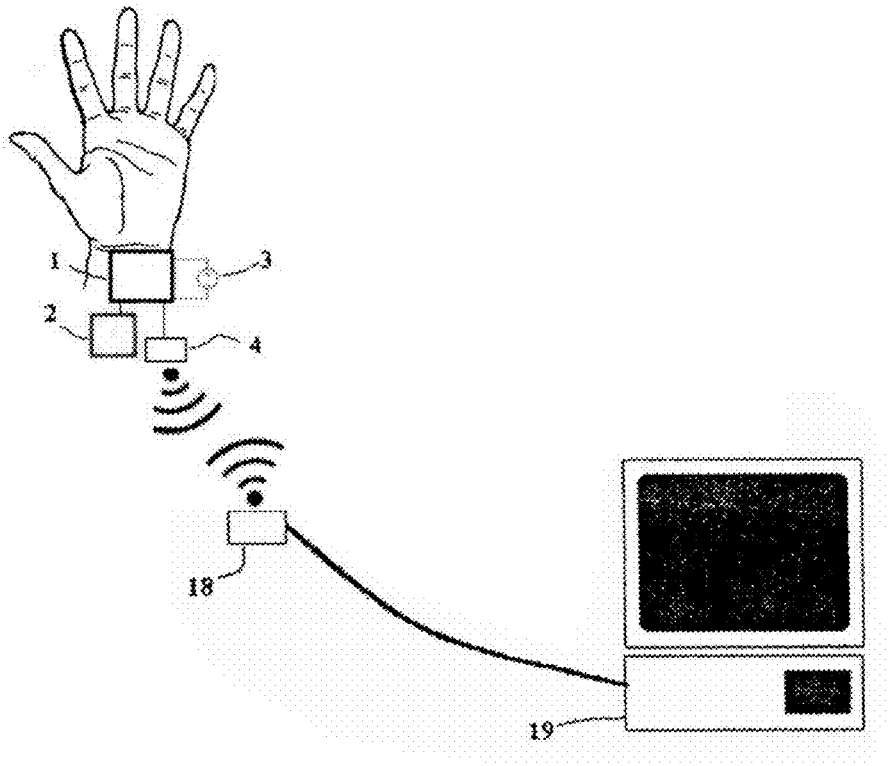

One input device 300 of the system of this embodiment is shown in FIGS. 2*a* and 2*b*. The input device 300 includes a 3D accelerometer housing 14 and a wristband 17 for physically relating the measuring device to the hand during masturbation movement. One of ordinary skill in the art recognizes that the wristband 17 can be attached to any part of a user, for example a user's hand or forearm. One of ordinary skill in the will also recognize that the wristband 17 could wrap around a moving object or item. The accelerometer housing 14 contains an accelerometer 2, a power supply 3, and an IC chip 1 that includes storage of data generated by the accelerometer 14. The device 300 also includes a Bluetooth® transmitter 4 for transmitting the data generated by the accelerometer 2 to a first processor 18. Oscillating motion of the hand is detected by the input accelerator 2 and is processed in a processor 1 and transmitted to a receiver 18 through the transmitter 4. The receiver 18 transmits the signal to a processor or CPU 19 for further processing and transmission to the CPU/remote processor 102.

Figure 3:
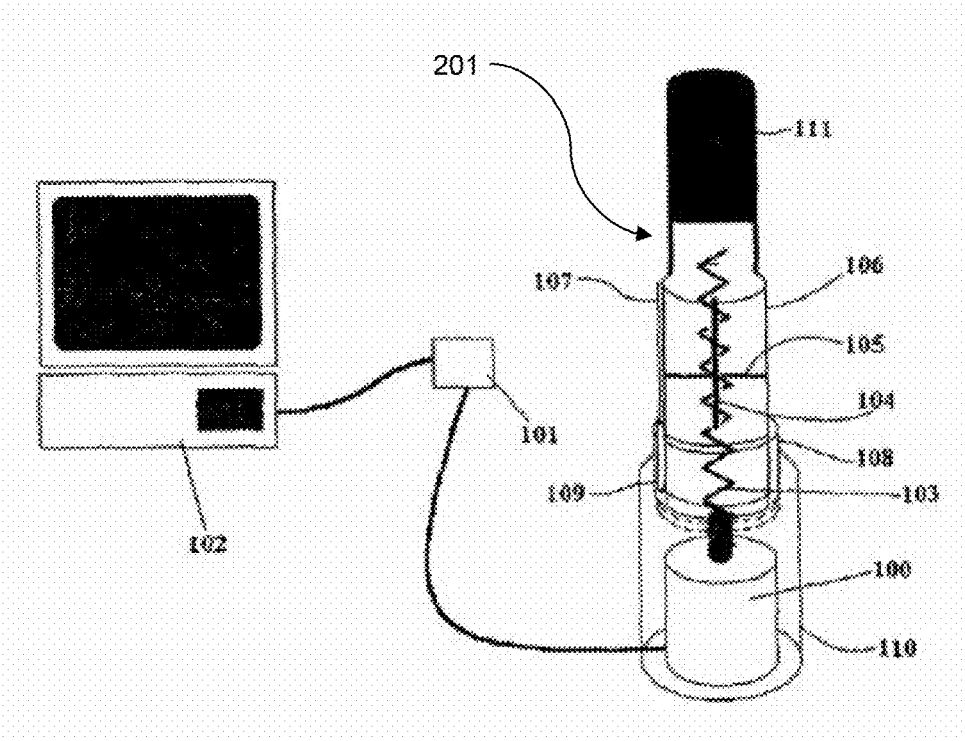
FIG. 3 shows the output device of the remote interaction system at the remote site.

FIG. 3 shows the output device 201 of the system of the present invention. As shown in FIG. 3, the output device 201 includes a motor 100 and driver circuitry 101 for controlling the speed and direction of said motor 100. The driver circuitry 101 receives data from a CPU 102. The data is related to data generated by processing circuitry 18 of the input device 300 (shown in FIG. 1) and transmitted by a CPU 19 of the input device 300 and the driver circuitry 101 causes the motor 100 to turn in accordance with said data. The output shaft of the motor 100 is attached to a spring coil 103 so that said spring coil 103 rotates around its longitudinal axis as the motor's shaft turns. A pin 104 is arranged inside the spring coil 103. The pin 104 is oriented along its main axis and includes two arms 105 protruding traverse to the pin 104 through the coil 103. The arms 105 attach to a hollow thrusting tube 106 which has the same main axis as the coil and surrounds the spring coil 103 and pin 104 assembly. The thrusting tube 106 has a fin 107 on its outside surface which is oriented along the main axis of the thrusting tube 106. The system furthermore comprises a steadying tube 108 where the inside diameter of said steadying tube 108 is slightly larger than the outside diameter of the thrusting tube 106 and where the steadying tube 108 has a groove 109 on its inside surface which is slightly larger in size than the fin 107 on the thrusting tube 106. The thrusting tube 106 is positioned inside the steadying tube 108 so that the fin 107 is in the groove 109. The thrusting tube 106 is flanged at its base so that movement through the steadying tube 108 is ended when the thrusting tube's 106 base meets the steadying tube's 108 base. The steadying tube 108 is affixed to the base 110 of the output device 201 where the base 110 contains the motor 100. The output device 201 includes a phallic object 111 which is affixed to the thrusting tube 106.

Based on digital data that is passed from the CPU 102 to the driver circuitry 101, the driver circuitry 101 causes the motor 100 to turn at various speeds and in both directions. As the motor 100 turns, the spring coil 103 turns and this causes the pin 104 and the arms 105 to move in a direction away from or towards the motor 100 depending on the direction of rotation of spring coil 103. As the pin 104 and the arms 105 move, the thrusting tube 106 and the phallic object 111 are caused to move accordingly. The output device 201 of the present invention provides a means for creating a thrusting motion of the phallic object 111 based on digital data received from the processor 102. The phallic object 111 is supported by a spring so that the force of impact against obstructing walls can be softened.

The embodiment described above allows a first user to transmit the motions of his masturbating hand directly to a remote thrusting phallic object as said user observes the motions of this phallic object where the phallic object's motions are in relative synchrony with the motions of the first user's hand so that second user is stimulated by said phallic object and where one or both users can view video over of the other user as both engage in this interaction. The CPU 19 can be connected to the internet or some other network connection with the CPU 102. The CPU 19 and CPU 102 are configured to transmit and receive data related to the motions of the input device 300.

Figure 4:
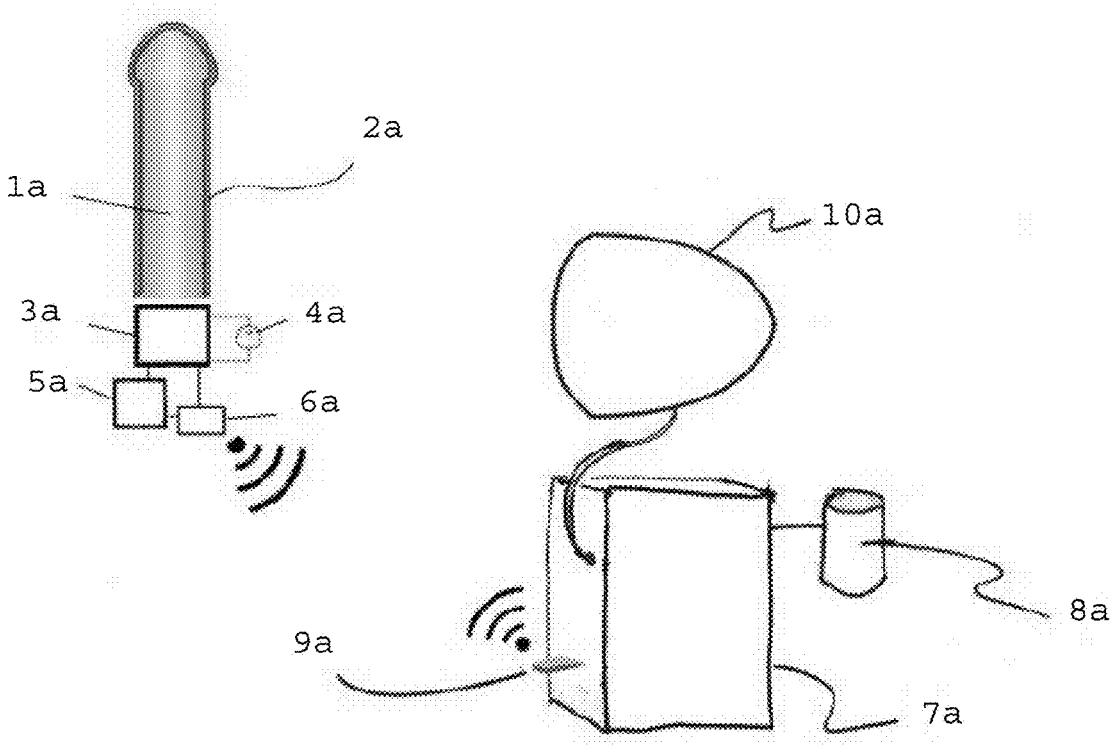
FIG. 4 shows the input device of the remote interaction system.

In another embodiment shown in FIG. 4, a dildo 1*a* comprises a phallic shaped housing 2*a*, an accelerometer 3*a*, a power source 4*a*, a processor 5*a*, and a wireless transmission means 6*a*. This embodiment includes a processor 7*a* which has data storage means 8*a* for storing software and data, and a receiving means 9*a* for receiving data from transmission means 6*a* and display 10*a*. This embodiment is similar to the embodiment from FIGS. 1-3, and provides an interactive system for transferring motion to the dildo 1*a* that is based on data from a remote input.

Figure 5:
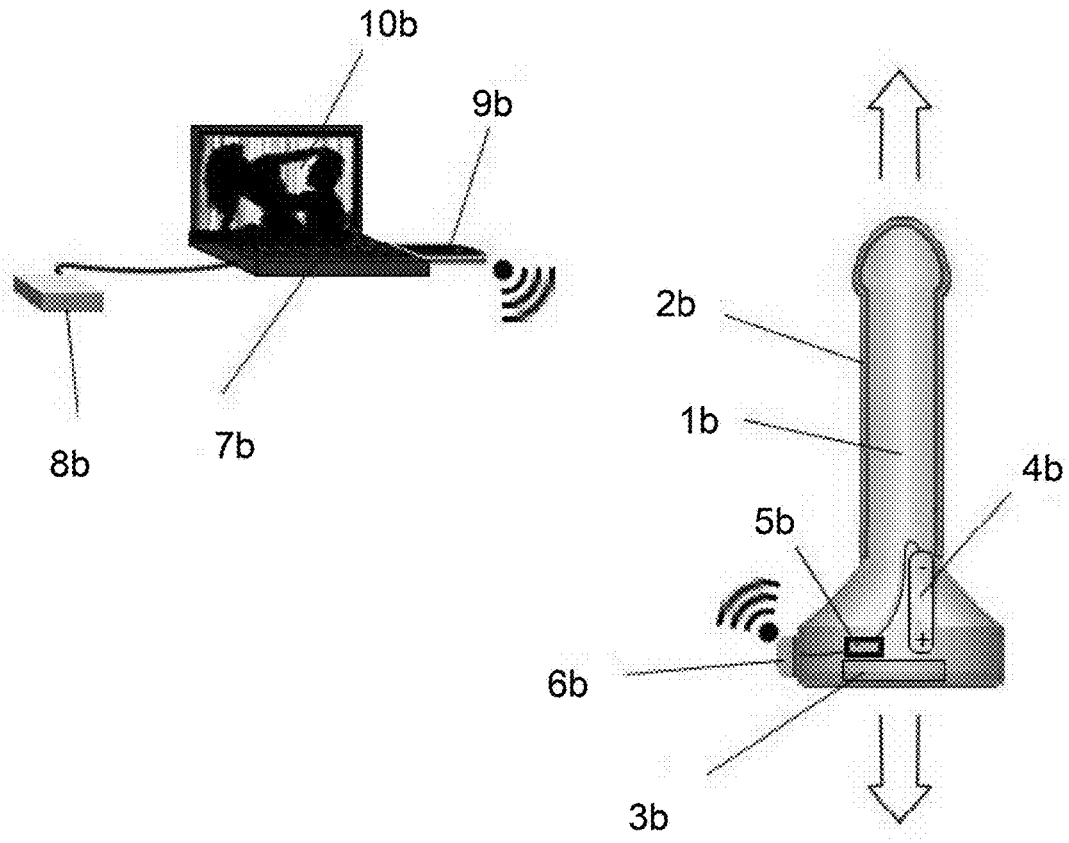
FIG. 5 shows the system of one embodiment of the present invention as implemented with erotic software.

FIG. 5 shows an embodiment in which a user picks up the dildo 1*b*, then the accelerometer 3*b* generates data related to the movement of the dildo 1*b* in three dimensions. This data is processed in a processor 5*b* and is transmitted by the transmission means 6*b* to the receiving means 9*b* for use in the processor 7*b*. The processor 7*b* uses software stored in the storage means 8*b* to display imagery on the display 10*b* which images are related to the data generated by the accelerometer 3*b*.

Figure 6:
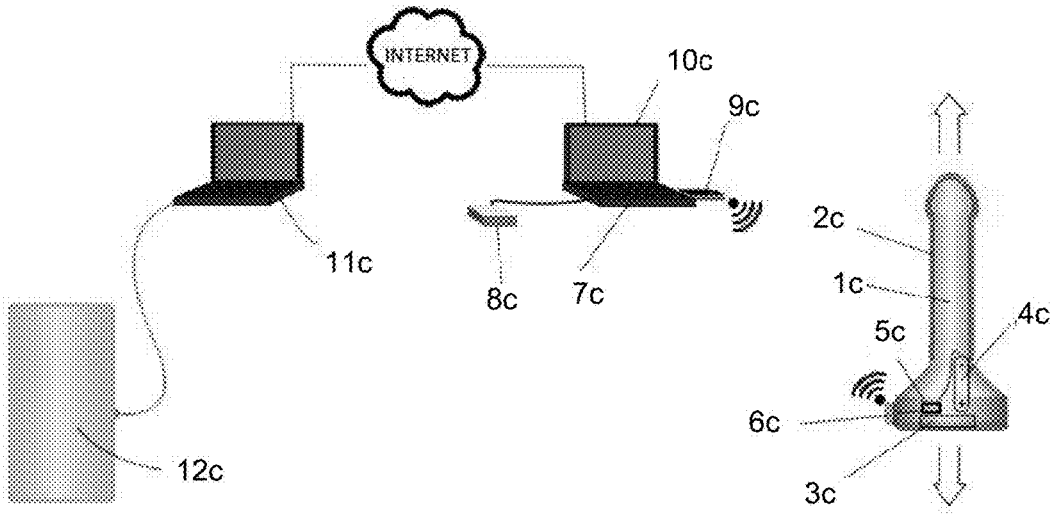
FIG. 6 shows the system of one embodiment of the present invention as implemented with remote interaction using sex toy-to-sex toy connection.

An alternative system of the current invention is shown in FIG. 6 where the user picks up the dildo 1*c* and the accelerometer 3*c* generates data related to the movement of the dildo 1*c* in three dimensions. This data is processed in the processor 5*c* and transmitted by the transmission means 6*c* to the receiving means 9*c* for use in the processor 7*c*. The processor 7*c* uses software stored in storage means 8*c* to transmit data related to movement of the accelerometer 3*c* to a remote processor 11*c* which causes a remote device 12*c* to operate in a way that is related to data generated to the accelerometer 3*c*. In one embodiment, the remote device 12*c* is a device for erotic interaction that is wirelessly or wired connection to the remote processor 11*c*. The remote device 12*c* can include another dildo, similar to dildo 1*c*, a vibrating stimulation device, a housing or sleeve configured to receive a penis, or any other erotic stimulation device. One of ordinary skill in the art recognizes that the dildo 1*c* or remote device 12*c* can vary to include any erotic stimulation device. Similarly, the dildo 1*c* (input device) or remote device 12*c* (output device) can include a manual device, such as a controller, to vary the corresponding output on the opposite end of the manual device.

Figure 7:
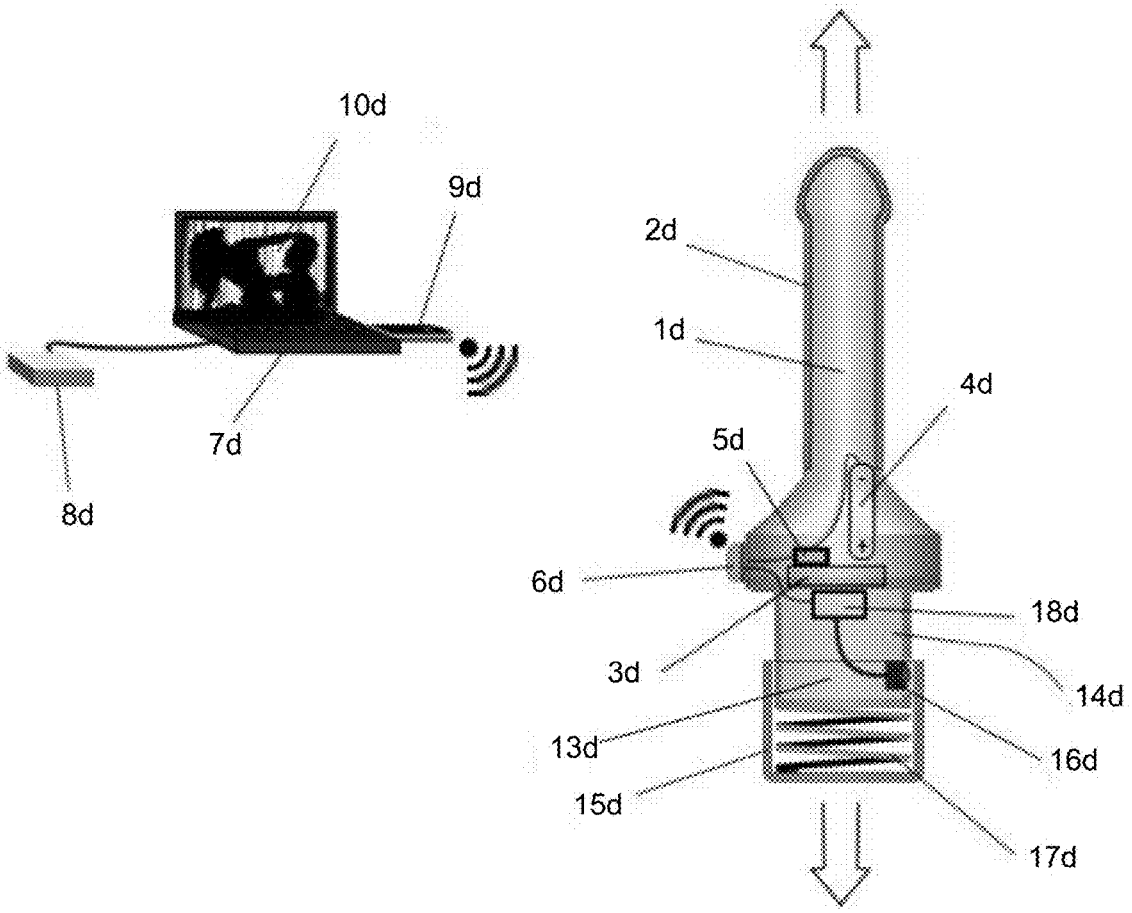
FIG. 7 shows an alternative embodiment of the input device of the current invention.

FIG. 7 shows another embodiment of the device of the present invention. This embodiment includes the ability to detect when the dildo engages a surface, such as skin or an orifice. As FIG. 7 shows, the device of this embodiment includes a dildo 1*d* that comprises a phallic shaped housing 2*d*, an accelerometer 3*d*, a power source 4*d*, a processor 5*d*, and wireless transmission means 6*d*. The device of this embodiment includes a processor 7*d* which has a data storage means 8*d* for storing software and data, and a receiving means 9*d* for receiving data from the transmission means 6*d* and a display 10*d*. In addition, this embodiment includes a force sensor 13*d* which detects force applied to the dildo 1*d* in the longitudinal axis of the dildo 1*d* in either direction, for example in the up and down direction as shown in FIG. 7. One of ordinary skill in the art will recognize that all directions of the dildo 1*d* can be detected by the force sensor 13*d*. In this embodiment the force sensor 13*d* is a pair of cups, including an outer cup 14*d* and an inner cup 15*d* that are aligned with the dildo 1*d* where the inner cup 14*d* is inserted in the outer cup 15*d* but the inner cup 14*d* and the outer cup 15*d* are not physically attached to each other and the outer cup 15*d* moves along the longitudinal axis of the inner cup 14*d* and of the dildo 1*d*. A spring 17*d* acts to force the inner cup 14*d* and the outer cup 15*d* to a certain relative position when there is no force on the dildo 1*d* acting against a force applied to outer cup 15*d*. An optical sensor 16*d* detects movement of the outer cup 15*d* relative to the cup 14*d* through a pattern printed on the inside of the outer cup 15*d*. Data from the optical sensor 16*d* is acquired by an optical processor 18*d* which sends data relative to said movement to the receiver 9*d* through the transmitter 6*d*. One of ordinary skill in the art recognizes that other types of processors can be used, besides an optical sensor 18*d*. The receiver 9*d* sends data generated by the optical sensor 16*d* to the processor 7*d* and the processor 7*d* uses data generated by the optical sensor 16*d* in conjunction with data generated by the accelerometer 6*d* to determine when the dildo 1*d* moves in three dimensions and when there is a force such as a drag force applied to the dildo 1*d*. For example, associated software running in the processor 7*d* can determine that the dildo 1*d* is inserted in an orifice if there is a substantial drag force and if the dildo 1*d* is moving along its longitudinal axis. In this embodiment, the motion of the dildo 1*d* is completely digitized by the computing means attached to the dildo 1*d*, and the data regarding this motion is transferred to the remote processor 7*d*. The data transmission between the remote processor 7*d* and the dildo 1*d* can go in both directions. In one embodiment, data regarding the motion displayed on the display means 10*d* (such as a pornographic video) is transferred to the dildo 1*d* such that the dildo 1*d* mimics motion of a corresponding component from the display means 10*d*.

This embodiment also allows a user of a phallic device to input data to a computer which data is related to movements of the phallic device. A system is described that uses the device of this invention to control aspects of erotic software running on a processor. A second system is described that allows first user of local device to send data related to movement of local device to a remote device so that second user of the remote device can feel movements of remote device which movements are related to movements of local device of first user. A second embodiment of the device of the present invention is described which embodiments includes means for sensing a force applied to the phallic device thereby allowing processor to determine if the phallic object is obstructed or in an orifice.

Figure 8:
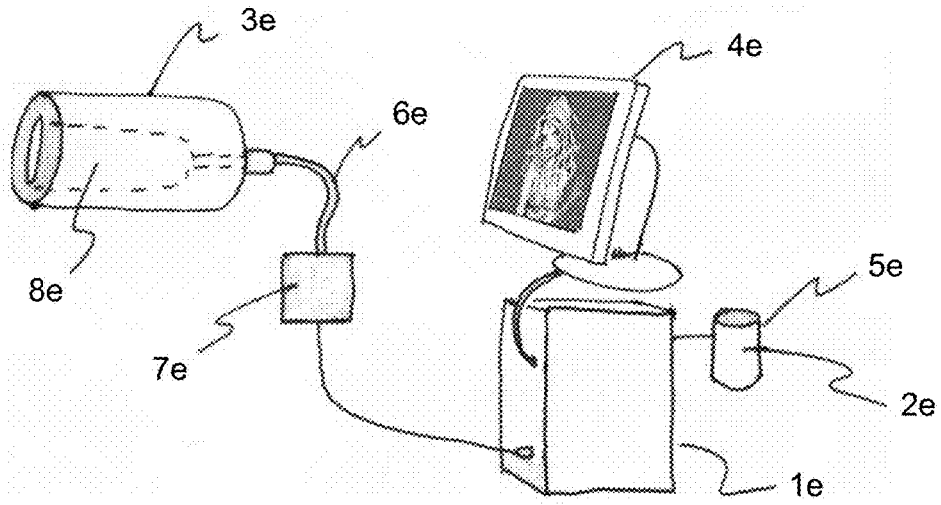
FIG. 8 shows one embodiment of the present invention including an input device and pressure transducer.

FIG. 8 illustrates another embodiment of the present invention. FIG. 8 illustrates the system this embodiment includes CPU 1*e* for processing software 2*e* and for receiving input from an input device 3*e*. In one embodiment, the processing software 2*e* is pornographic game software. The CPU 1*e* creates visual data displayed to the user on a display device 4*e*. The system includes software 2*e* stored on data storage 5*e*. The input device 3*e* comprises a rubber material that approximates the feeling of flesh and that has an orifice 8*e* for receiving a phallic object. The orifice 8*e* of the input device 3*e* is open to a tube 6*e* so that any fluctuations in pressure in the orifice 8*e* cause changes in pressure in tube 6*e*. The system of this embodiment furthermore includes a pressure transducer 7*e* that is connected to the tube 6*e* and that measures any fluctuations of pressure in the tube 6*e* and that transmits that pressure data to the CPU 1*e* for use in the game software 2*e*. In this embodiment, the motion displayed on the display device 4*e*, such as an actor or actress in a film, is digitized by the CPU 1*e* and transmitted to the pressure transducer 7*e* and tube 6*e* such that the motion from the display device 4*e* is substantially mimicked by the tube 6*e*. In another embodiment, the motion from the tube 6*e* is transmitted to a game software 2*e* such that a character, actor, or actress responds to the fluctuations in pressure from the tube 6*e* in response to a user's motions.

Figure 9A:
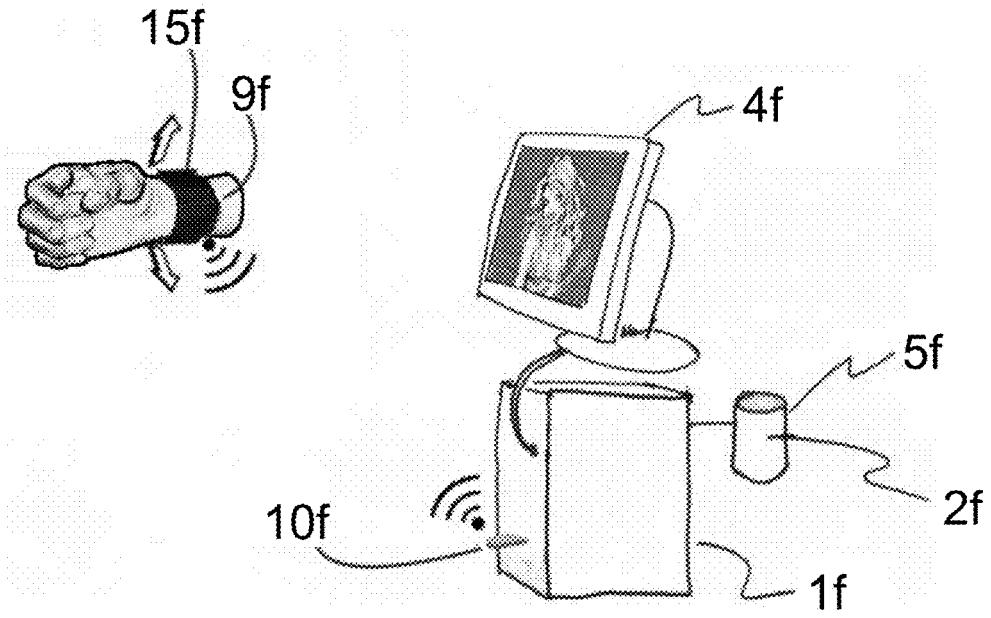
FIGS. 9*a* and 9*b* show alternative embodiments of the present invention including a 3D accelerometer.
Figure 9B:
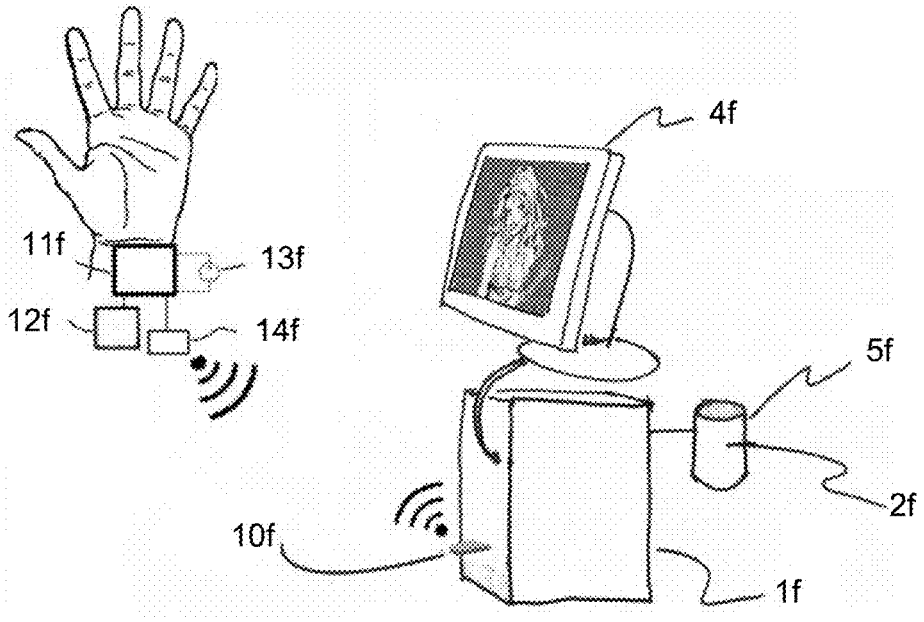

FIGS. 9*a* and 9*b* show alternative embodiments where the input device includes a 3D accelerometer housing 9*f* and a wristband 15*f* for physically relating the measuring device to the hand during masturbation movement. The housing 9*f* contains an accelerometer 12*f*, a power supply 13*f* and an IC chip 11*f* that includes storage of data generated by accelerometer. The device also includes a Bluetooth transmitter 14*f* for transmitting the data generated by the accelerometer 12*f* to a receiver 10*f*. Oscillating motion of the hand is detected by an input accelerator 12*f* and processed in a processor 11*f* and transmitted to the receiver 10*f* through the transmitter 14*f* which transmits to the CPU 1*f* for further processing.

One of ordinary skill in the art will recognize that the wristband 15*f* can be varied, to include any modular sensor. One of ordinary skill in the art recognizes that the general concept of using a remote device with a sensor, such as the one included on the wristband 15*f*, can be attached to a variety of parts of a user, such as a user's finger or genitals, and stimulation is either received or transmitted by the remote device. The stimulation sent to or received by the remote device is provided by a remote input, such as an erotic film, a remote secondary user, a videogame, or any other stimulation input.

In one embodiment of the software described above, there is, for example, a series of frames that contain photo-realistic images of a character which character is an actress. The user of the game interacts with that character. The frames are organized in groups where each group represents one complete action of the character. Some of these groups are hereby termed Perpetual Motion Anitons, or Repetitive Motion Anitons. A Perpetual Motion Aniton is hereby defined as an object related to an action of a character that can be consecutively combined with other Perpetual Motion Anitons in a random fashion so that this combined series of anitons comprises a random perpetual movement of the character. In one embodiment, the Perpetual Motion Aniton is related to the motion of an object, media, file, image, or other element. Furthermore, the game includes groups of frames that are hereby termed Singular Motion Anitons. A Singular Motion Aniton is a group of frames that relate to an action that is not repeated. For example, a Singular Motion Aniton can be the act of raising a finger to the chin, and an act that is not repeated over time. The game can disrupt the display of Perpetual Motion Anitons to interject any Singular Motion Aniton in accordance with game play. The game displays different anitons based on the logic of the game as processed in the CPU 1*f*. In the system of the present invention this game play includes input from input device 3*f* that affects the display of anitons so that it creates the illusion that the user is affecting actions in the game.

Therefore, the invention presented allows a user to transmit the motions of his masturbating hand or masturbation device to software which software relates those self-stimulating motions of the user's hand or masturbation device to actions occurring in visual images on his screen which visual images are displayed back to the user so that the tactile feedback from his masturbatory motion combined with the video feedback generated by the software that is synchronized with said masturbatory motion gives the user the illusion of participating in sex acts depicted on his screen. While a specific embodiment of this invention is described, it should be understood that components of this invention can be implemented in various ways. It is intended to claim such modifications of the invention that include such implementations.

What is claimed is:

1. A system for modifying a sex toy for digitized sexual interaction, the system comprising:

a first sex toy;

a movable input device including a sensor, wherein the moveable input device is adapted to be attached to the first sex toy for detecting movements of the movable input device and the sensor, and a first processor connected to said sensor, wherein the first processor determines an output signal based at least in part on signals from the sensor; and the first processor communicates the output signal to an output device, the output device comprising:

a second remote processor configured to receive the output signal from the movable input device, wherein the output signal is adjusted corresponding to the signals from the sensor, and transmit instructions to a driver circuitry based on the received output signal from the movable input device; and a motor that receives the instructions from the driver circuitry to move the output device based on the received output signal from the movable input device.

2. The system of claim 1, wherein the movable input device comprises a band, and the band is adapted to wrap around the first sex toy.

3. The system of claim 1, further comprising a display including a video component that corresponds to movement detected by the sensor.

4. The system of claim 1, further comprising a display connected to the movable input device and a camera at the output device.

5. The system of claim 1, wherein the sensor is configured to detect a drag force applied to the first sex toy.

* * * * *